United States Patent [19]

Duce

[11] Patent Number: 4,885,992

[45] Date of Patent: Dec. 12, 1989

[54] VERTICAL ROTARY INDIRECT PRINTER

[75] Inventor: Richard W. Duce, Clio, Mich.

[73] Assignee: General Motors Corporation, Detroit, Mich.

[21] Appl. No.: 235,419

[22] Filed: Aug. 24, 1988

[51] Int. Cl.[4] ..... B41F 17/22

[52] U.S. Cl. ..... 101/38.1; 101/120

[58] Field of Search ..... 101/40, 39, 35, 120, 101/119, 38.1

[56] References Cited

U.S. PATENT DOCUMENTS

| | | | |
|---|---|---|---|
| 2,924,169 | 9/1955 | Scott | 101/40 |
| 3,424,082 | 1/1969 | Gray, Jr. | 101/40 |
| 3,425,344 | 2/1969 | Jaeger | 101/120 X |
| 3,685,442 | 8/1972 | Harwell, Jr. | 101/119 |
| 4,384,518 | 5/1983 | Albin | 101/40 |
| 4,640,188 | 2/1987 | Cosson et al. | 101/39 |

*Primary Examiner*—Clifford D. Crowder
*Attorney, Agent, or Firm*—R. W. Tung

[57] ABSTRACT

A rotary indirect printing assembly for printing objects to be sequentially cycled past the assembly including a printing drum presenting a printing surface and a platform with the printing drum rotatably supported upon the platform. The assembly also includes a transfer roller presenting a transfer surface with the transfer roller rotatably supported upon the platform and rotating in time with the printing drum. The printing surface of the printing drum and the transfer surface of the transfer roller are in tangential rotational contact with respect to each other to transfer an ink image from the printing surface to the transfer surface to transfer the image to an object as an object is sequentially cycled past the assembly. The printing drum and the transfer roller are disposed vertically with respect to the platform.

6 Claims, 2 Drawing Sheets

VERTICAL ROTARY INDIRECT PRINTER

BACKGROUND OF THE INVENTION (1) Technical Field

The subject invention relates to a vertical rotary indirect screen printer used for printing images on objects which are sequentially cycled past the printer.

(2) Description Of The Prior Art

The subject invention relates to a vertical rotary indirect screen printer used for printing images on objects which are sequentially cycled past the printer. More specifically, the subject invention is directed toward a rotary indirect screen printer used for printing cylindrical objects such as spark plug insulators or the like.

Indirect printing assemblies are old in the art and a number of apparatuses have been employed in the past to print objects such as spark plug insulators. For example, U.S. Pat. No. 2,924,169 issued on Feb. 9, 1960 to Scott, discloses a method and apparatus for printing cylindrical objects such as spark plug insulators including a horizontally disposed, rotating printing wheel which is in rotational and tangential contact with cylindrical engraved plates to transfer an image from the plate to the spark plug insulators.

Silk screening technology has also been employed in the art as evidenced by U.S. Pat. No. 4,640,188 issued on Feb. 3, 1987 to Cosson et al. The Cossan et al '188 patent discloses a silk screen transfer printing apparatus for cylindrical objects including a print transfer drum which is rotatable about horizontal axis. A screen printing head is arranged horizontally above the print transfer drum and is brought down into contact with horizontal pads to transfer an image from the screen printing head to the pads. The drum is then rotated to orientate the pads in a vertical position and the pads brought into contact with the spark plug insulator to transfer the image from the pad to the insulator.

Still another example of the prior art is shown in U.S. Pat. No. 3,685,442 issued on Aug. 22, 1972, to Harwell, Jr. The Harwell, Jr. '442 patent discloses a rotary offset silk screening apparatus with squeegee adjustments wherein a continuous screen defining an image to be printed is mounted within the periphery of a rotary head. Ink is then forced through the screen onto a soft elastomeric rotor positioned for tangential contact with the periphery of the mounted screen. The image picked up by the soft elastomeric roller is transferred to a work piece. The Harwell, Jr. '442 patent also discloses a means for selectively adjusting the position of the squeegee to vary the pressure of the squeegee as it bears against the continuous screen.

However, although the prior art as discussed above accomplishes the objects of those inventions, simplicity is sacrificed in an effort to transfer an image from a print head to the object to be printed. The prior art represents complex apparatus with many moving parts and expensive components. Further, many printers require that the object be indexed from a vertical to a horizontal position to be printed. Then, it is necessary to again index the object to a vertical position. This further complicates the printing process and adds costs to the assemblies. Finally, to the extent the prior art discloses printing apparatuses wherein the object to be printed does not need to be indexed horizontally, those assemblies are awkward and do not result in a clear and precise image on the printed object.

SUMMARY OF THE INVENTION AND ADVANTAGES

The rotary indirect printing assembly of the subject invention includes a printing drum presenting a printing surface with the printing drum rotatably supported upon a platform. The assembly also includes a transfer roller presenting a transfer surface with the transfer roller also rotatably supported upon the platform and rotating in time with the printing drum. The printing surface of the drum and the transfer surface of the transfer roller are in tangential rotational contact with respect to each other to transfer an ink image from the printing surface and to the transfer surface to transfer the image to an object as the object is sequentially cycled past the assembly. The assembly is characterized by the printing drum and the transfer roller being disposed vertically with respect to the platform.

The subject invention overcomes the problems attendant the prior art by employing a rotary indirect printing assembly of simple construction and having relatively few moving parts. Further, the printing drum and transfer roller are disposed vertically with respect to the platform alleviating the need to index the object to be printed to the horizontal position but still resulting in a high quality, clear and precise image on the printed object.

BRIEF DESCRIPTION OF THE DRAWINGS

Other advantages of the present invention will be readily appreciated as the same becomes better understood by reference to the following detailed description when considered in connection with the accompanying drawing wherein.

DESCRIPTION OF THE PREFERRED EMBODIMENT

Figure 1:
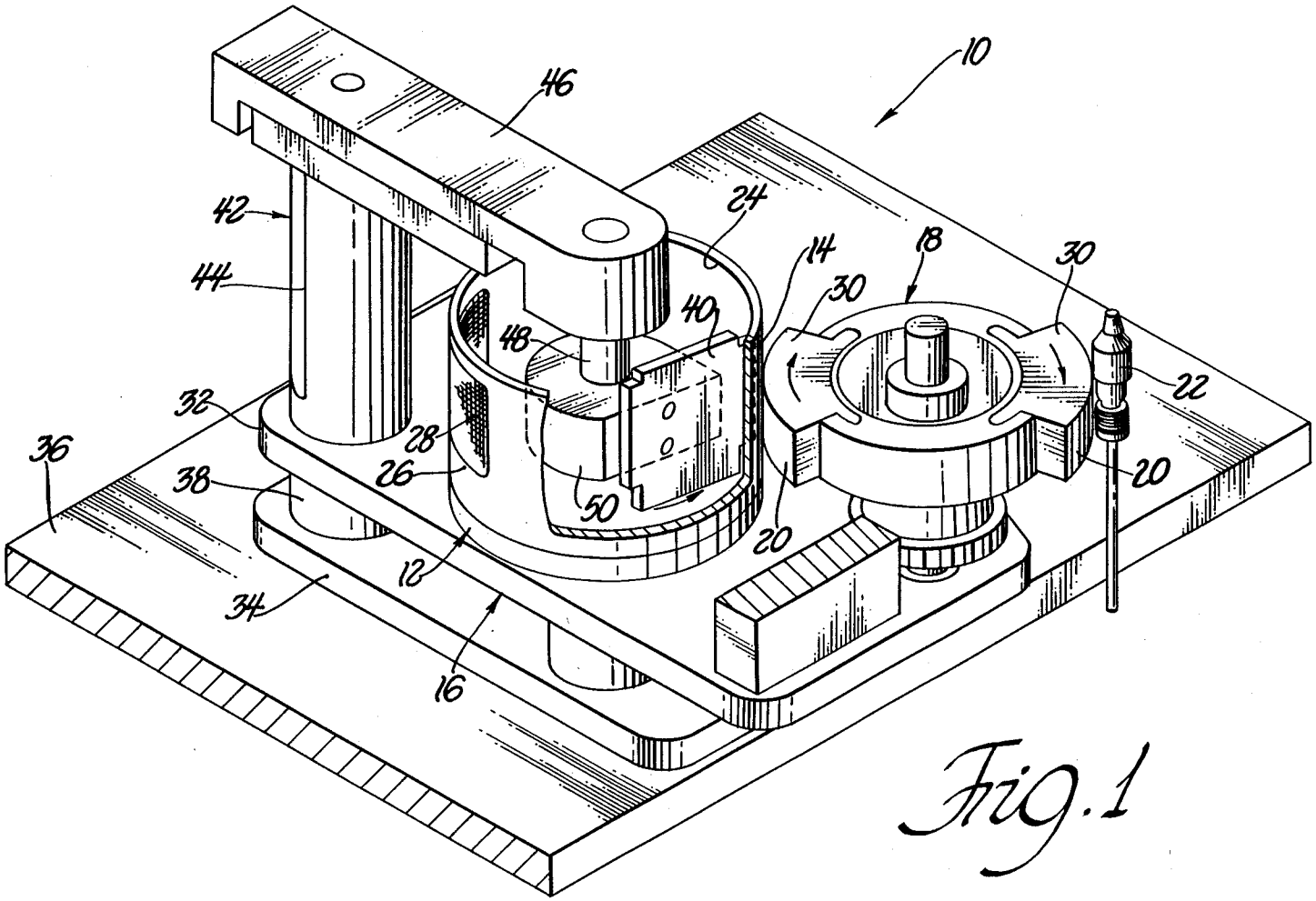
FIG. 1 is a perspective view of the printing assembly of the subject invention.

A rotary indirect printing assembly for printing objects to be sequentially cycled past the assembly is generally shown at 10 in FIG. 1. The printing assembly 10 includes a printing drum generally indicated at 12 and a platform generally indicated at 16 defining a horizontal plane. The printing drum 12 is rotatably supported upon the platform 16 and includes a printing surface 14. The assembly 10 also includes a transfer roller, generally indicated at 18, presenting a transfer surface 20. The transfer roller 18 is rotatably supported upon the platform 16 and rotates in time with the printing drum 12. The printing surface 14 of the drum 12 and the transfer surface 20 of the transfer roller 18 are in tangential rotational contact with respect to each other to transfer an ink image from the printing surface 14 to the transfer surface 20 to transfer the image to an object 22 as the object 22 is sequentially cycled past the assembly.

The printing drum 12 also includes an interior surface 24 defining a hollow space interior of the printing surface 14. At least one opening 26 is disposed in the printing surface 14 and a printing screen 28 is mounted in the opening 26. The screen 28 defines an image to be transferred to the transfer surface 20 on the transfer roller 18 to transfer the image to an object 22 as is commonly known in the art. In the preferred embodiment, the printing drum 12 is cylindrical and the opening 26 is semicircular. Further, it has been found to be advantageous that the drum 12 include two semicircular openings 26 with a printing screen 28 mounted in each openings 26.

With respect to the transfer roller 18, the transfer surface 20 defines at least one semicircular lobe portion 30. In the preferred embodiment, the transfer roller 18 includes two transfer surfaces 20 defining two semicircular lobed portions 30. Further, the transfer roller 18 is cylindrical. The transfer roller 18 is preferably made of a silicon material that has the ability to pick up and release ink. The transfer roller 18 is a smooth soft pad which reduces wear and protects the printing screen 28 and may be in the form of any configuration to accommodate the size and shape of any part to be printed.

The printing drum 12 and the transfer roller 18 are geared to each other to rotate in time such that at least one of the semicircular lobe portions 30 comes into rolling contact with the printing screen 20 mounted in at least one of the semicircular openings 26 to transfer an image from the screen 28 to the transfer surface 20 and then to the object 22 as the transfer roller 18 rotates and as the object 22 is sequentially cycled past the assembly 10.

The platform 16 includes upper and lower portions 32 and 34 respectively, and disposed in parallel spaced relationship with respect to one another. The assembly 10 may rest on any suitable surface such as a base 36. Blocks 38 are disposed between the upper and lower portions 32 and 24 of the platform to space the same. A set of gears (not shown) are also disposed between the upper and lower portions 32 and 34 and operatively interconnect the printing drum 12 and the transfer roller 18 such that the drum 12 and the roller 18 rotate in time with respect to each other. The gears are driven by a motor (not shown). This insures that an image found on the screen 28 will be transferred to the surface 20 and from the surface 20 to the object 22 as it, in turn, is sequentially cycled past the assembly 10. Further, the drum 12 and roller 18 may be made to rotate in time by any suitable means such as with a geared belt or any other suitable means known in the art.

The assembly also includes a squeegee 40 vertically disposed and fixedly secured within the interior hollow space defined by the interior surface 24 of the drum 12 to evenly distribute ink over the interior surface 24. More specifically, the squeegee 40 is in bearing contact with the printing screen 28 to distribute ink evenly over the screen 28. The assembly 10 also includes a support means, generally indicated at 42 for fixedly supporting the squeegee 40 in a stationary position within the interior space of the cylindrical printing drum 12. The support means 42 includes a telescoping pillar 44 extending vertically upwardly from the platform 16, generally, and specifically from the upper portion 32 of the platform 16. A cross member 46 is operatively connected to the pillar 44 and extends horizontally therefrom. A rod portion 48 is fixedly secured to the cross member 46 opposite to the connection to the pillar 44. The rod 48 extends vertically downwardly and terminates in a shoe portion 50. The squeegee 40 is fixedly secured to the shoe portion 50. The cross member 46 is pivotable in a horizontal plane at the connection to the pillar 44. Accordingly, the squeegee 40 may be removed from the interior space of the drum 12 when the pillar 44 is telescoped to an extended position and the cross member 46 swung away from the drum 12. In this way, the squeegee 40 may be cleaned or replaced. Further, the pressure with which the squeegee 40 bears against the interior surface 24 of the drum 12 may be varied by pivotally positioning the cross member 46. Said another way, when the squeegee 40 is disposed within the interior space of the drum 12, the amount of pressure brought to bear on the interior surface 24 by the squeegee 40 may be selectively adjusted by pivoting the cross member 46 either toward the interior surface 24 or away therefrom.

Figure 2:
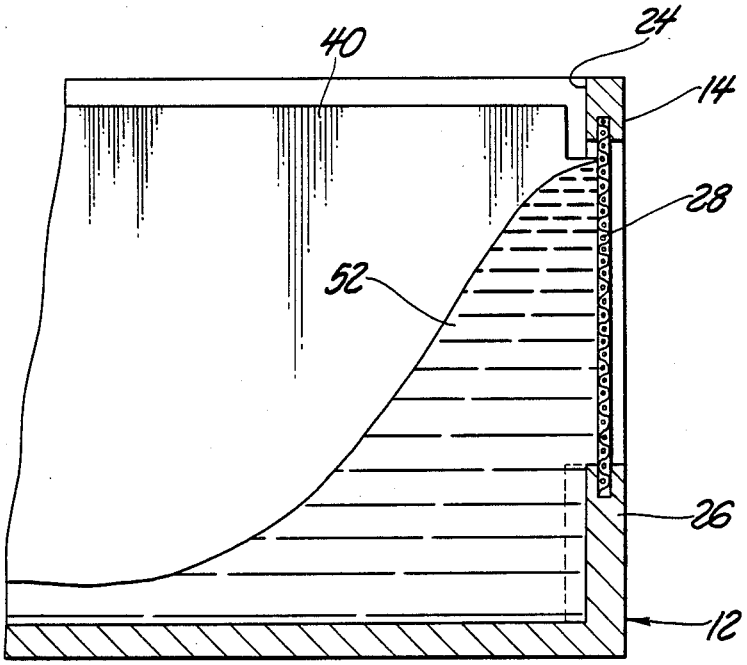
FIG. 2 is a partial cross-sectional side view of the printing assembly of the subject invention.

The printing drum 12 and the transfer roller 18 are disposed vertically with respect to the horizontal plane of the platform 16. The interior space defined by the interior surface 24 of the cylindrical drum 12 is generally in the shape of a cup. Printing ink is dispensed into the drum and forms a level at the bottom of the drum 12. As shown in FIG. 2, the vertically disposed and stationary squeegee 40 prevents the ink 52 from moving with the drum 12 as the drum rotates causing the ink 52 to accumulate in the front of the squeegee 40. Since the ink 52 is being prevented from moving with the drum 12, it is forced up the side of the squeegee 40 onto the screens 28. This effectively floods the screens 28 with ink 52 eliminating the need for a flood bar, which is necessary in most screen printing applications. The ink 52 is made to ride up the squeegee 40 and cover the full length of the screens 28 in a uniform coating. The amount of ink 52 in the drum is controlled by an ink dispensing system which is commonly known in the art (not shown). In this way, the screens 28 defining the images to be printed are continuously supplied with printing ink.

In its operative mode, the assembly 10 may be disposed on any surface 36 in conjunction with a means for sequentially cycling an object 22 such as a spark plug insulator past the assembly 10. A mechanical switch, or the like, is employed to signal the assembly 10 to rotate the print drum 12. The drum 12 rotates moving the screen image past the squeegee 40. At the same time, the transfer roller 18 is rotated and comes into tangential contact with the drum 12 at the screen 28, transferring the screen image onto the transfer surface 20. The transfer roller 18 continues to rotate to bring the transfer surface 20 into tangential contact with the spark plug insulator. The insulator is rotated by the force of the roller 18 on the insulator. In this way, a clear and precise image is transferred to the surface of the insulator.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A rotary indirect printing assembly for printing objects to be sequentially cycled past said assembly, said assembly comprising; a printing drum presenting a printing surface, a platform defining a horizontal plane, said printing drum rotatably supported upon said platform, a transfer roller presenting a transfer surface, said transfer roller rotatably supported upon said platform and rotating in time with said printing drum, said printing surface of said drum and said transfer surface of said transfer roller being in tangential rotational contact with respect to each other to transfer an ink image from said printing surface to said transfer surface to transfer said image to an object as the object is sequentially cycled past the assembly, said printing drum and said transfer roller being disposed vertically with respect to said horizontal plane of said platform, the improvement comprising said printing drum including an interior surface defining a hollow space interior of said printing surface and forming a cup for holding ink, said assembly including a squeegee vertically disposed and fixedly secured in a stationary position within said interior hollow space and projecting into the ink in said cup, said squeegee forcing the ink vertically up said interior surface of said printing drum to evenly distribute ink over said interior surface and forcing the ink through said drum to said transfer roller.

2. An assembly as set forth in claim 1 further characterized by said printing drum including at least one opening in said printing surface and a printing screen mounted in said opening, said squeegee bearing contact with said printing screen to distribute ink evenly over said screen, said screen defining said image to be transferred to said transfer surface on said transfer roller to transfer said image to an object as the object is sequentially cycle past the assembly.

3. An assembly as set forth in claim 2 further characterized by said printing drum being cylindrical and said at least one opening being semicircular, said transfer roller being cylindrical and said transfer surface defining at least one semicircular lobed portion, said printing drum and said transfer roller being geared to each other to rotate in time such that said at least one semicircular lobe portion comes into rolling contact with said printing screen mounted in said at least one semicircular opening to transfer said image from said screen to said transfer surface and then to the object as said transfer roller rotates and as the object is sequentially cycled past the assembly.

4. An assembly as set forth in claim 3 further characterized by said assembly including a support means for fixedly supporting said squeegee in said stationary position within said interior space of said cylindrical printing drum.

5. An assembly as set forth in claim 4 further characterized by said support means including a telescoping pillar extending vertically upwardly from said platform, a horizontally extending cross member pivotally connected to said pillar, a rod portion secured to the cross member opposite the connection to said pillar, said rod extending vertically downwardly and terminating in a shoe portion, said squeegee fixedly secured to said shoe portion.

6. An assembly as set forth in claim 5 further characterized by said drum including two semicircular openings and said printing screen mounted in each opening, said transfer roller including two transfer surfaces defining two semicircular lobed portions, said assembly including a motor for driving said drum and said transfer roller to rotate in time with each other.

* * * * *